United States Patent [19]

Brillantes

[11] 4,432,287

[45] Feb. 21, 1984

[54] INCINERATOR AND HEARTH CONSTRUCTION THEREFOR

[75] Inventor: Bonifacio B. Brillantes, Orangeburg, N.Y.

[73] Assignee: Morse Boulger, Inc., Glen Cove, N.Y.

[21] Appl. No.: 260,420

[22] Filed: May 4, 1981

[51] Int. Cl.[3] ..... F23B 5/00; F23C 9/00; F23G 7/06

[52] U.S. Cl. ..... 110/212; 110/210; 110/248; 110/290; 110/300

[58] Field of Search ..... 110/203, 210, 211, 235, 110/244, 248, 251, 290, 300, 346, 212, 187, 245, 298, 299; 122/40

[56] References Cited

U.S. PATENT DOCUMENTS

| | | | |
|---|---|---|---|
| 519,779 | 5/1894 | Thomas | 110/299 |
| 685,444 | 10/1901 | Casey | 110/300 |
| 801,251 | 10/1905 | Kilbourne et al. | 110/248 |
| 1,072,571 | 9/1913 | Canham | 110/290 |
| 3,068,812 | 12/1962 | Hemeon | 110/210 |
| 3,416,469 | 12/1968 | Dvirka et al. | 110/7 |
| 3,448,704 | 6/1969 | Dvirka | 110/165 |
| 3,503,348 | 3/1970 | Dvirka | 110/8 |
| 3,537,410 | 11/1970 | Zanft | 110/8 |
| 3,543,700 | 12/1970 | Baigas, Jr. | 110/8 |
| 3,547,055 | 12/1970 | Zanft | 110/8 |
| 3,552,335 | 1/1971 | Dvirka et al. | 110/8 |
| 3,563,187 | 2/1971 | Zanft | 110/7 |
| 3,602,161 | 8/1979 | Wyrough | 110/7 |
| 3,716,001 | 2/1973 | Potasek et al. | 110/8 |
| 3,842,762 | 10/1974 | Sargent et al. | 110/14 |
| 3,869,994 | 3/1975 | Von Berlichingen | 110/235 |
| 4,123,979 | 11/1978 | Tesch | 110/212 |
| 4,356,778 | 11/1982 | McRee, Jr. | 110/212 |

*Primary Examiner*—Albert J. Makay
*Assistant Examiner*—Steven E. Warner
*Attorney, Agent, or Firm*—Lalos, Leeds, Keegan, Lett & Marsh

[57] ABSTRACT

An incinerator including a housing defining a combustion chamber, a hearth mounted in the chamber, the hearth having a plurality of vertical openings, air passageways in the hearth each communicating with at least one of the vertical openings, a burner mounted in the housing below the hearth, and an exhaust stacking means for conducting combustion gases into the atmosphere.

37 Claims, 4 Drawing Figures

INCINERATOR AND HEARTH CONSTRUCTION THEREFOR

This invention relates to incinerators and more particularly to incinerators providing a novel hearth design. This invention further contemplates incinerators with a novel design providing for greater burner exposure time of the combustion gases.

In the past, incineration has been found to be the most practical and economical method of solid waste disposal. However, incinerators of past designs have been unsatisfactory in both single and multi-stage construction because combustible materials were not totally consumed and the combustible pollutants contained in the exhaust gases were discharged into the atmosphere thereby polluting the environment. Two factors are involved in this regard. First, the refuse material was not completely exposed to the burner fire resulting in slow or incomplete combustion. And, second, the exhaust gases flowed through the burners, after burners, and exhaust conduits to rapidly for the burners to completely consume the gaseous pollutants.

It is, therefore, a principal object of the present invention to provide a novel incinerator design.

Another object of the present invention is to provide a novel incinerator design for rapidly and efficiently reducing and disposing of heterogenous refuse.

A further object of the present invention is to provide a novel incinerator design which provides maximum combustion of the refuse, resulting in exhaust gases containing fewer pollutants.

A still further object of the present invention is to provide a novel incinerator design which includes burner fire injected underneath and through the refuse hearth.

Another object of the present invention is to provide a novel incinerator design which includes burner fire injected underneath and through the refuse hearth and air injected underneath and across the top of the refuse.

A further object of the present invention is to provide a novel design for an incinerator with a primary and secondary combustion chamber in which the combustion gases have a longer residence time in the secondary combustion chamber whereby more complete combustion results.

Other objects and advantages of the present invention will become apparent to those persons having ordinary skill in the art to which the invention pertains, from the following description taken in conjunction with the accompanying drawings wherein.

Briefly described, the present invention pertains to an improved incinerator including a primary combustion chamber and burner, a secondary chamber and burner, a stack through which the spent gases exhaust into the atmosphere, a hearth on which the refuse is deposited for burning thereon, the hearth having vertical openings through which burner flames enter and horizontal passageways communicating with the vertical openings through which additional air is injected, the secondary chamber communicating with the primary chamber, a restricted opening through which the exhaust gases pass from the secondary chamber into the stack and a stoking means for depositing the refuse onto the hearth.

Figure 1:
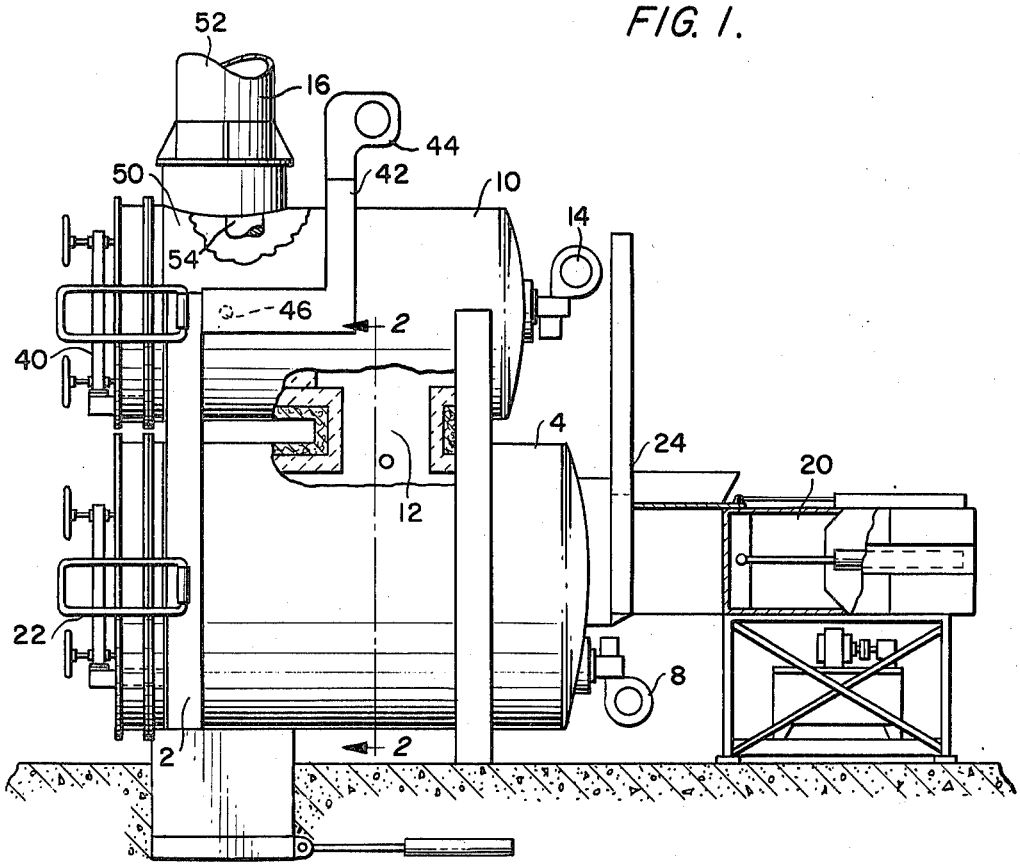
FIG. 1 is a side view of an embodiment of the invention with a part thereof broken away.

Referring to FIG. 1, a specific embodiment of the present invention is illustrated. The principal components of the invention are the housing 2 which defines the primary combustion chamber 4, a hearth 6 which provides a burning surface whereon the refuse is deposited, a primary burner 8 positioned below the hearth, a secondary combustion chamber 10 adjacent primary chamber 4, flue 12 joining and placing the chambers in communication, a secondary burner 14, exhaust stack 16, and a stoking means shown generally at 20.

Figure 2:
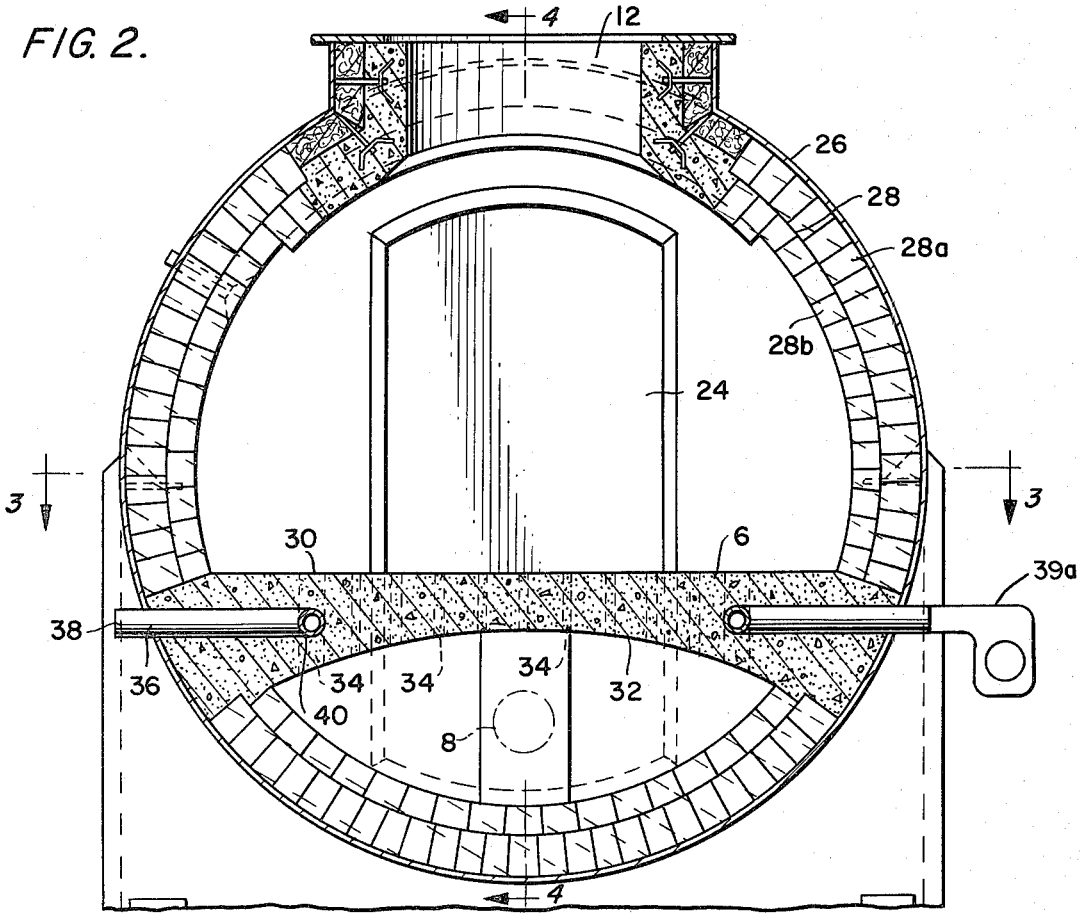
FIG. 2 is vertical cross-sectional view of the primary combustion chamber taken along line 2—2 in FIG. 1; the optional blower is illustrated therein in dotted lines.

Primary chamber 4, as best shown in FIGS. 1 and 2, is generally horizontally-extended and cylindrical in shape. The primary chamber is enclosed at both ends, at one end by a cleanout door 22 and at other by a guillotine stoker door 24. Door 24 is positioned allowing stoker 20 to deposit the refuse on hearth 6 with minimal heat loss.

Primary chamber 4 comprises an outer metallic casing 26 and an inner lining of refractory material 28. These casing and liners may be of any suitable material which is normally used in incinerators. FIG. 2 shows the refractory material to comprise an outer layer of firebrick 28*a* and an inner layer of archbrick 28*b*, the two layers having nonaligned seams.

Figure 3:
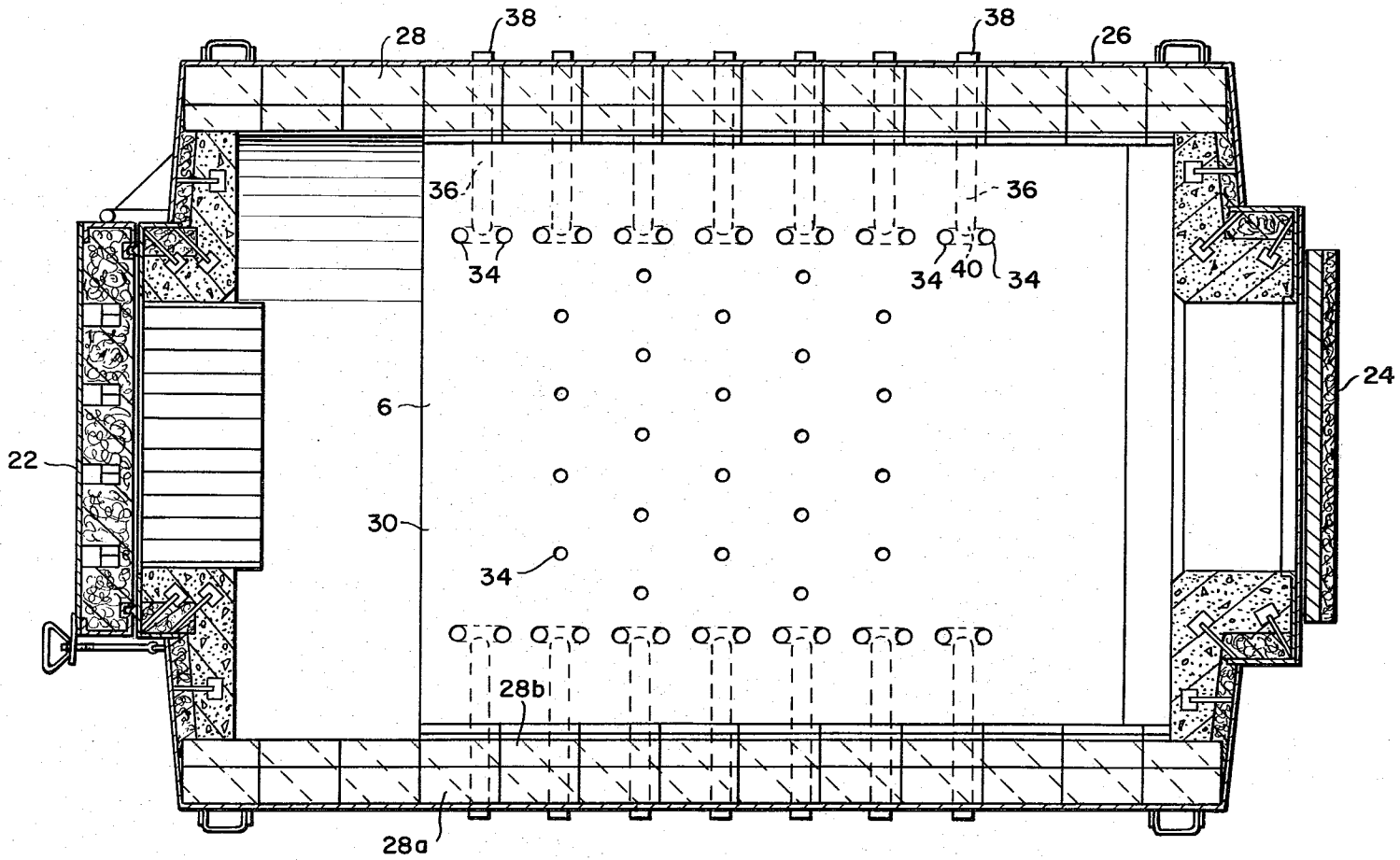
FIG. 3 is a horizontal cross-sectional view taken along line 3—3 in FIG. 2.
Figure 4:
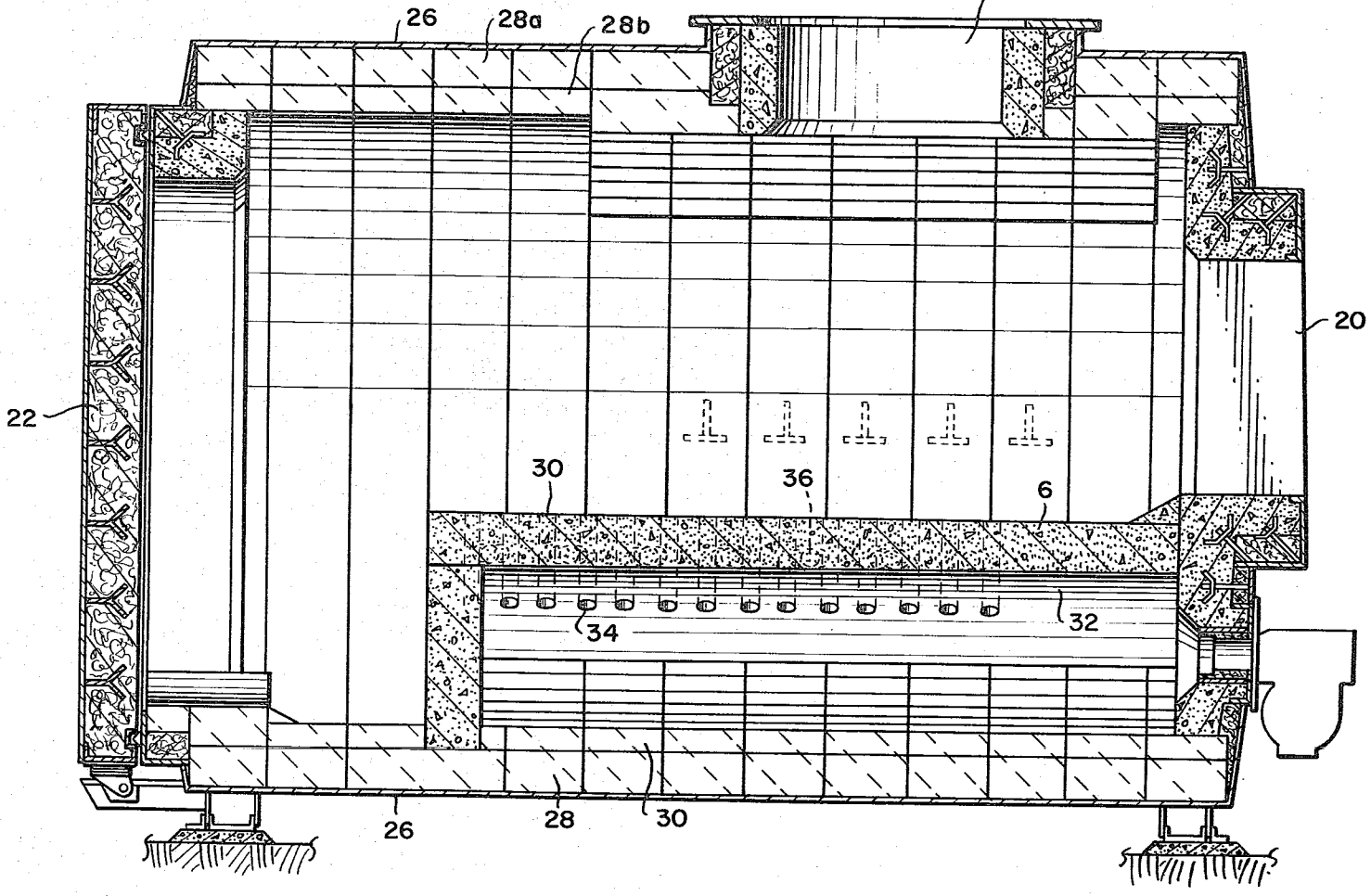
FIG. 4 is a vertical cross-sectional view taken along line 4—4 in FIG. 2.

Hearth 6 is comprised of a single slab of suitable material, for example, as contemplated by the present embodiment, it is made of hydrecon reinforced with stainless steel fibers. The upper surface 30 is generally flat, while the lower surface 32 defines an arched configuration, as portrayed in FIG. 2. A plurality of vertical openings 34 penetrate the hearth, engaging surfaces 30 and 32. As best shown in FIG. 3, these openings are spaced in a uniform pattern to expose the maximum surface of the refuse to the burner flame. The hearth also includes a plurality of essentially horizontal passageways 36 having ends 38 and 40. In the present embodiment, these passageways have been tar coated.

The passageways 36 penetrate the refractory material 28 and the metallic casing 26 whereby ends 38 outlet to the atmosphere. These passageways may be provided with blower fans at ends 38. Ends 40 communicate with at least one vertical opening 34 and in the present embodiment each is shown to communicate with two vertical openings.

Thus, air flows from the atmosphere at ends 38 to the vertical openings 34 providing additional air to the burner flame. The flow of air through the incinerator is generally through the vertical openings from hearth lower surface 32 to upper surface 30 whereby a slight vacuum is created at ends 38 causing air to be sucked in from the atmosphere. As previously pointed out, optional blower fan 39*a* illustrated in FIG. 2 blows air into end 38 may also be employed to provide additional air flow through the passageways.

Secondary chamber 10 is generally of the same shape and construction, including a metallic casing enclosing layers of refractory material, as primary chamber 4 only of slightly smaller dimensions. The secondary chamber, as best shown in FIG. 1, is positioned in alignment with and directly above the primary chamber. The chambers communicate through a flue 12, which is also lined with refractory material.

A secondary chamber cleanout door 40 is at one end of the secondary burner generally positioned above the primary chamber's cleanout door. The secondary burner 14 is mounted at the opposite end. An overfire air plenum 42 is positioned around the outside upper half of the secondary chamber and the optional air fan 44 forces air through the plenum 42 and into the secondary chamber through overfire air nozzle 46.

Exhaust stack 16 is positioned above the secondary combustion chamber. It has base 50 and top 52. Base 50 is connected to the secondary combustion chamber only through a restricted opening 54. This forces a longer residence time of the gases in the secondary chamber allowing for more complete burning of the particular matter. Thus, the gases exhausting from the stack are more completely burned and less pollutant.

From the foregoing detailed description, it will be evident that there are a number of changes, adaptations and modifications of the present invention which come within the province of those persons having ordinary skill in the art. However, it is intended that all such variations not departing from the spirit of the invention be considered as within the scope thereof as limited solely by the appended claims.

I claim:

1. An incinerator comprising:

a primary combustion chamber, a secondary combustion chamber communicating with said primary combustion chamber, a hearth having an upper horizontal surface and a generally horizontal lower surface mounted in said primary combustion chamber, said hearth having a plurality of vertical passageways engaging said upper surface and said lower surface, a plurality of generally horizontally disposed air passageways passing through said hearth and each of said air passageways communicating with said supplying air to at least one of said vertical passageways at a location between said upper surface and said lower surface, a primary burner mounted in said primary combustion chamber below said hearth, and an exhaust stacking means associated with said secondary combustion chamber and having an opening to the atmosphere and having a base.

2. The incinerator according to claim 1 including, a forcing means for forcing air into said air passageways.

3. The incinerator according to claim 1 including, an introducing means for introducing air over said hearth.

4. The incinerator according to claim 1 including, a charging means for charging refuse onto said hearth.

5. The incinerator according to claim 1 including, at least one of said air passageways communicating with more than one of said vertical passageways.

6. The incinerator according to claim 1 including, at least one vertical cross-section of said lower surface being curved.

7. The incinerator according to claim 1 including, said hearth being supported at opposite ends on side walls of said primary combustion chamber.

8. The incinerator according to claim 1 including, each said air passageway having one end communicating with at least one said vertical passageway and an opposite end exposed to the atmosphere.

9. The incinerator according to claim 1 including, at least one said air passageway having one end communicating with at least one said vertical passageway and an opposite end passing through said lower combustion chamber to an outer surface of said lower combustion chamber.

10. The incinerator according to claim 9 including, said opposite end being connected to a blower disposed outside of said primary combustion chamber.

11. The incinerator according to claim 1 including, an exhausting means for exhausting generally all of the combustion gases from said secondary combustion chamber through said exhaust stacking means to the atmosphere, said exhausting means consisting of a natural draft.

12. The incinerator according to claim 1 including, an escaping means for allowing the escape of the combustion gases from said secondary combustion chamber to said base, said escaping means comprising a restricted opening through which generally all of the combustion gases must pass to exit from said secondary combustion chamber to said base, and said escaping means providing for a residence time of the combustion gases in said secondary combustion chamber.

13. The incinerator according to claim 12 including, an exhausting means positioned between said opening and the atmosphere for exhausting generally all of the combustion gases from said secondary combustion chamber through said exhaust stacking means to the atmosphere, said exhausting means consisting of a natural draft.

14. The incinerator according to claim 1 including, a conducting means for conducting combustion gases emanating from said secondary combustion chamber to said base, said conducting means including a surface positioned between said secondary combustion chamber and said exhaust stacking means base and having an opening of small dimensions for allowing escape of the combustible gases to the atmosphere through which generally all of the combustion gases must pass.

15. The incinerator according to claim 14 including, an exhausting means positioned between said surface opening and the atmosphere for exhausting generally all of the combustion gases from said secondary combustion chamber through said exhaust stacking means to the atmosphere, said exhausting means consising of a natural draft.

16. The incinerator according to claim 1 including, a means for introducing air under said hearth.

17. The incinerator according to claim 16 including, a forcing means for forcing additional air into said secondary chamber.

18. The incinerator according to claim 1 including, a secondary burner positioned in said secondary combustion chamber for injecting a flame into said secondary combustion chamber.

19. The incinerator according to claim 18 including, a surface disposed between said secondary combustion chamber and said base, said surface having a restricted opening through which generally all of the combustion gases must pass and adapted to provide for a residence time of the combustion gases in said secondary combustion chamber for more complete combustion prior to exhausting through said exhaust stacking means.

20. The incinerator according to claim 18 including,
an exhausting means positioned between said surface opening and the atmosphere for exhausting generally all of the combustion gases from said secondary combustion chamber through said exhaust stacking means to the atmosphere,
said exhausting means consisting of a natural draft.

21. The incinerator according to claim 19 including,
an exhausting means positioned between said surface opening and the atmosphere for exhausting generally all of the combustion gases from said secondary combustion chamber through said exhaust stacking means to the atmosphere,
said exhausting means consisting of a natural draft.

22. The incinerator according to claim 1 including,
at least one of said air passageways communicating with more than one of said vertical passageways.

23. In an incinerator having a combustion chamber including first and second regions, and a burner for injecting a flame into one of said chamber regions, a hearth construction on which refuse may be deposited for burning comprising:
a refuse supporting body disposed between said chamber regions and supported in said combustion chamber,
said supporting body having a plurality of generally vertically disposed passageways intercommunicating said first and second chamber regions,
said supporting body having at least one fluid supply passageway communicable with a source of combustion supporting fluid and communicating with at least one of said plurality of passageways,
said fluid supply passageways being disposed within said supporting body,
said fluid supply passageways being generally horizontally disposed,
said supporting body being generally horizontally disposed,
said supporting body having an upper horizontal surface and a generally horizontal lower surface,
each said vertically disposed passageway having an upper end engaging said upper surface and a lower end engaging said lower surface, and
each said fluid supply passageway communicating with and supplying fluid to at least one of said vertically disposed passageways at a location between said upper end and said lower end.

24. The hearth construction according to claim 23 including,
at least one of said fluid supply passageways communicating with two of said vertically disposed passageways.

25. The hearth construction according to claim 23 including,
each said fluid supply passageway having one end communicating with at least one said vertically disposed passageway and an opposite end passing through said combustion chamber to an outer surface of said combustion chamber.

26. The hearth construction according to claim 23 including,
said plurality of passageways being uniformly distributed over a horizontal area of said supporting body.

27. The hearth construction according to claim 23 including,
said fluid supply passageway communicating with a source of air.

28. The hearth construction according to claim 27 including,
said fluid supply passageways communicating directly with the atmosphere.

29. The hearth construction according to claim 27 including,
said source of air including a blower means for blowing air into said fluid supply passageways.

30. The hearth construction according to claim 23 including,
an introducing means for introducing air over and under said refuse supporting body.

31. The hearth construction according to claim 30 including,
said introducing means being adapted so that air flows upwardly through said vertically disposed passageways.

32. The hearth construction according to claim 23 including,
said burner being positioned generally below said supporting body.

33. The incinerator according to claim 1 including,
a forcing means for forcing air into said air passageways.

34. The incinerator according to claim 33 including,
said forcing means forcing air via said air passageways to said vertical passageways so that a portion of the air travels downwardly through at least one said vertical passageways and a portion of the air travels upwardly through at least one said vertical passageways.

35. The hearth construction according to claim 23 including,
said fluid passageways being positioned so that air passes through said fluid passageways to and through said vertical passageways.

36. The hearth construction according to claim 35 including,
a forcing means for forcing air into said fluid passageways.

37. The hearth construction according to claim 36 including, said forcing means forcing air via said fluid passageways to said vertical passageways so that a portion of the air travels downwardly through at least one said vertical passageway and a portion of the air travels upwardly through at least one said vertical passageway.

* * * * *